US005199903A

United States Patent [19]

Asick et al.

[11] Patent Number: 5,199,903

[45] Date of Patent: Apr. 6, 1993

[54] FERRULELESS BACK SHELL

[75] Inventors: John C. Asick; Karen E. Benjamin, both of Harrisburg; Earl W. McCleerey, Mechanicsburg, all of Pa.

[73] Assignee: AMP General Patent Counsel, Harrisburg, Pa.

[21] Appl. No.: 662,587

[22] Filed: Feb. 28, 1991

[51] Int. Cl.[5] ..... H01R 9/05

[52] U.S. Cl. ..... 439/610; 439/585

[58] Field of Search ..... 439/607, 609, 610, 585, 439/879, 877

[56] References Cited

U.S. PATENT DOCUMENTS

| | | | |
|---|---|---|---|
| 4,082,402 | 4/1978 | Kinkaid et al. | 439/877 |
| 4,337,989 | 7/1982 | Asick et al. | 339/143 R |
| 4,453,798 | 6/1984 | Asick et al. | 439/610 |
| 4,557,545 | 12/1985 | Ohtsuki et al. | 439/610 |
| 4,582,384 | 4/1986 | Frantz et al. | 439/610 R |
| 4,585,292 | 4/1986 | Frantz et al. | 339/143 R |
| 4,611,878 | 9/1986 | Hall et al. | 339/186 M |
| 4,653,836 | 3/1987 | Peele | 439/610 |
| 4,684,199 | 8/1987 | Ezure et al. | 439/610 |
| 4,737,124 | 4/1988 | Ezure et al. | 439/610 |
| 4,842,547 | 6/1989 | Defibaugh et al. | 439/460 |
| 4,900,262 | 2/1990 | Matsuzaki | 439/354 |
| 4,917,629 | 4/1990 | Matsuzaki et al. | 439/405 |

*Primary Examiner*—Larry I. Schwartz
*Assistant Examiner*—Hien D. Vu
*Attorney, Agent, or Firm*—David L. Smith

[57] ABSTRACT

A back shell assembly (2) for a multi-contact electrical connector (8) comprises back shell members (4) and (6) which can be latched together about the connector (8). One back shell member (2) has a first cable strain relief member (14) projecting therefrom and having side walls (28) and a base wall (26) which is formed with a pocket (32). The other back shell member (6) has projecting therefrom a second cable strain relief member (42) having a base wall (54) and side walls (56) from which project crimping flanges (62). When a shielded electrical cable (C) has been terminated to the connector (8) a portion of the cable (C) having the braid shield (S) thereof folded back therealong, is laid in second strain relief member (42) and the two strain relief members (14) and (42) and their back shell members (4) and (6) are mated after which flanges (62) are crimped down into the pocket (32) so that the cable is tightly gripped by the strain relief members (14) and (42) which make firm and permanent electrical connection with the braid shields (S).

27 Claims, 11 Drawing Sheets 122
114
115
123
116
122
118
120
132
124
127
134
129
126
124
128
132
130
128
C"
130
143
140
J"
W"
138
136
S"
139
144
164
162
148
140
150
142
162
160
143
166
148
165
146
174
142
150
149

FERRULELESS BACK SHELL

BACKGROUND OF THE INVENTION

This invention relates to a back shell for shielding a multi-contact electrical connector that has contacts adapted to be terminated to conductors of a shielded cable and to a cable strain relief means in said back shell.

There is disclosed in U.S. Pat. Nos. 4,337,989 and 4,611,878, a shielding back shell for a multi-contact electrical connector. The back shell comprises two back shell members which can be latched together about the connector and the end portion of a shielded, multi-wire electrical cable which has been terminated to contacts of the connector. Each back shell member comprises a semi-cylindrical tail portion, the tail portions cooperating to enclose a bared length of the braid shield of the cable on said end portion thereof. Before the wires of the cable are connected to the contacts of the connector, a tubular ferrule is threaded onto the cable, since the ferrule is too small for the connector to be passed therethrough. When the back shell members have been latched together about the cable with the said tail portions thereof embracing the bared length of cable shield, the ferrule is slid along the cable and over the tail portions then crimped thereabout to provide a cable strain relief and to make permanent electrical connection between the back shell members and the cable braid shield. Nevertheless, the use of such a ferrule can cause problems where a wire of the cable has been misplaced or tests indicate that the assembly so produced needs to be reworked, since any repair that requires the back shell to be reopened also requires the ferrule to be stripped and the connector to be completely re-terminated so that a new ferrule can be threaded onto the cable. Further, the ferrule can be incorrectly located for the crimping operation.

U.S. Pat. No. 4,842,547 discloses the use of a generally U-shaped staple having barbed legs, as a cable strain relief means for securing the end portion of a braid shielded electrical cable to the plastic housing of an electrical connector to which the cable has been terminated. The staple is inserted over the cable end portion, the shielding of which has been bared so that the barbed legs of the staple gouge in recesses in the plastic housing. Plastic material can of course "creep" under sustained pressure.

SUMMARY OF THE INVENTION

According to the present invention, two shielding back shell members collectively form a back shell for an electrical connector that is adapted to be connected to a shielded electrical cable. Each back shell member is provided with a strain relief shell member. The strain relief shell members are interchangeable with each other to enclose an end portion of the cable along which extends a bared length of the cable shield having the insulative jacket removed. The strain relief members are formed with flange and recess means, the flange means being crimpable into the recess means for securing the strain relief shell members in firm engagement with each other with the bared length of the cable shielding compressed therebetween. Thus, a separate ferrule is not required for threading onto the cable, and the back shell members can be reopened after the strain relief shell members have been interengaged but before the flange means is crimped. Also, no metal to plastic mechanical connection is relied upon to secure the strain relief shell members about the cable.

Each strain relief shell member may be formed integrally with the respective back shell member so that the entire back shell consists of only two parts which can be stamped and formed from a suitable sheet metal stock. The strain relief shell members may be latchable together in such a way that they cannot be relatively mislocated for the crimping operation.

Each strain relief shell member may be of generally U-shaped cross section, with a recess formed in the base wall of one of these members and flanges projecting from the free edges of the side walls of the other of these members for crimping into the recess.

If required, at least one of the strain relief shell members may be a separate item provided with structure for coupling it to the respective back shell member.

The strain relief shell members may be hermaphroditic, each having a recess and at least one flange. Thus, the flange of one of the strain relief shell members will be crimpable into the recess of the other and vice versa.

The strain relief member may be adapted to various cable gauges by indenting them to reduce the cross sectional area available for receiving the cable, for example, at the time of the crimping operation.

BRIEF DESCRIPTION OF THE DRAWING

FIG. 1A is a side view of a multi-contact electrical connector connected to a braid shielded electrical cable;

FIGS. 3A to 3C are views shown partly in section, and with parts omitted, illustrating the use of tooling during the steps illustrated in FIGS. 2C to 2E, respectively;

DESCRIPTION OF THE PREFERRED EMBODIMENT

Figure 1:
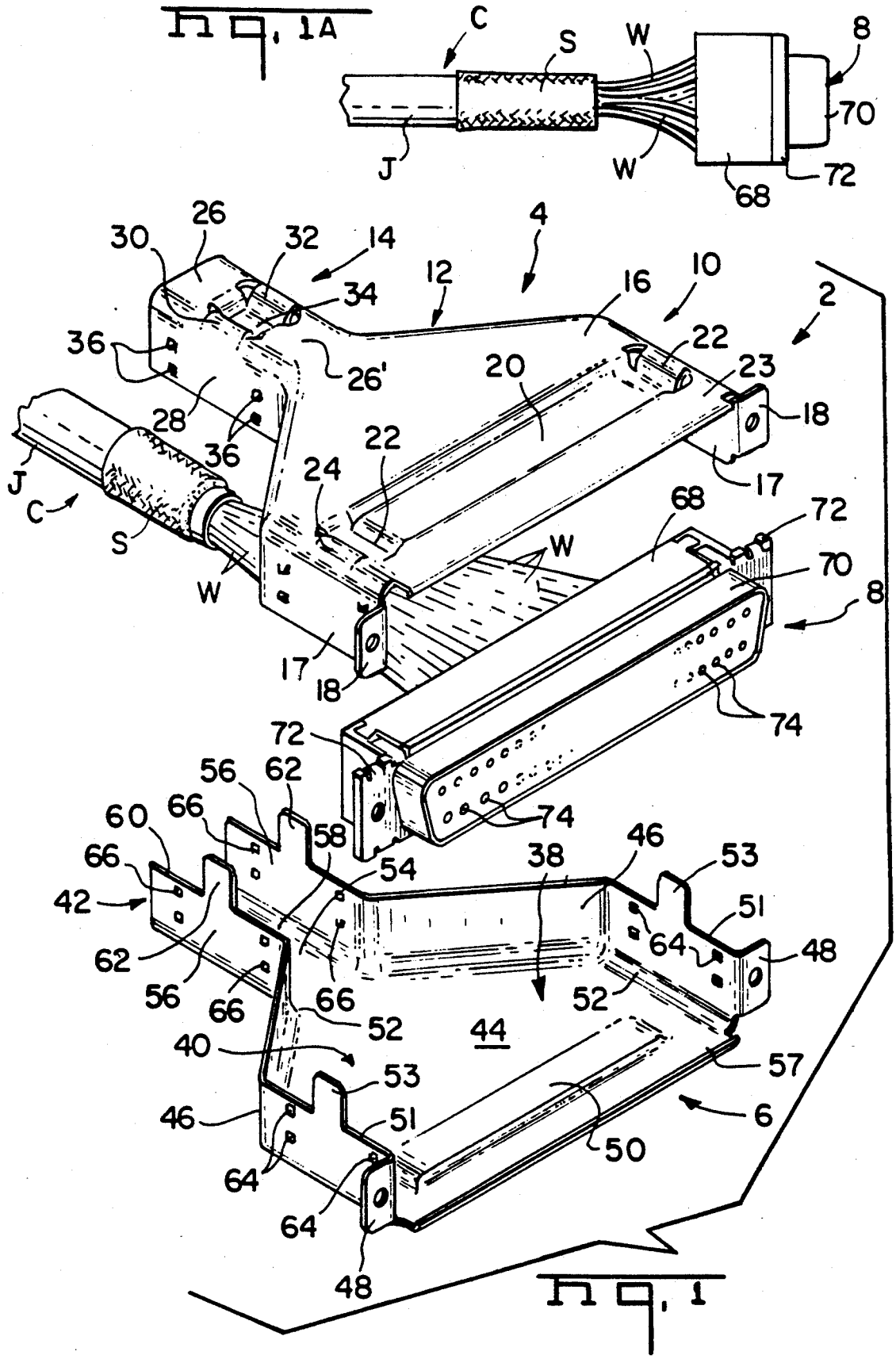
FIG. 1 is an exploded isometric view of a shielded electrical connector assembly incorporating a back shell according to a first embodiment of the invention.

As shown in FIG. 1, the shielded electrical connector assembly 2 comprises a shielding back shell consisting of upper and lower, one piece stamped and formed, back shell members 4 and 6 respectively, made, for example, of cold rolled steel and being according to a first embodiment of the invention; and a multi-contact electrical connector 8.

The back shell member 4 comprises a connector receiving, forward, shell part 10, a cable wire receiving shell part 12 tapering rearwardly away from the part 10, and a cable strain relief shell member 14 projecting rearwardly from the smaller, rear end of the part 12.

The back shell member 4 comprises a base wall 16 from which depend side walls 17 provided at their forward ends with connector mounting, apertured, flanges 18. The base wall 16 is formed with an inwardly projecting, connector engaging rib 20 extending across the shell part 10, just rearwardly of the flanges 18, and with an upwardly open, flange receiving recess 22 at each end of the rib 20. The transition 24 between each side wall 17 and the base wall 16 is rounded off, at least proximate to the respective recess 22. The part 10 is further provided with a forward, connector retaining skirt 23.

The strain relief shell member 14 comprises a base wall 26 extending rearwardly from the base wall 16 by way of a transition 26'. There depend from opposite edges of the base wall 26, parallel side walls 28, transitions 30 between the walls 26 and 28 being rounded, that is to say being outwardly convex. There extends across the base wall 26, intermediate its ends, a recess 32 between the rounded transitions 30, the recess 32 having a flat bottom 34. The side walls 17 of the shell part 10,12 are provided with window latch means, the side walls 28 of the shell member 14 also being provided with window latch means 36, all of these window latch means being shown only diagrammatically.

The back shell member 6 comprises a connector receiving, forward shell part 38, a cable wire receiving shell part 40 tapering rearwardly away from the part 38, and a cable strain relief shell member 42 projecting rearwardly from the smaller end of the part 40. The shell member 6 has a base wall 44 from which upstand side walls 46 provided at their forward ends with connector mounting, apertured flanges 48. The side walls 46 are of complementary shape to the side walls 17 of the back shell member 4. The base wall 44 is formed with a connector engaging rib 50 extending across the shell part 30 just rearwardly of the flanges 48, and projecting between the side walls 46. The transition 52 between each side wall 46 and the base wall 44 is rounded. There upstands from the free edge 51 of each side wall 46, a generally rectangular tab 53 located rearwardly of the respective flange 48. The strain relief shell member 42 comprises a base wall 54 extending rearwardly from the base wall 44 of the shell member 6, and parallel side walls 56 upstanding from opposite edges of the base wall 54, the transitions 58 between the walls 54 and 56 being rounded. The part 38 has a forward, connector receiving flange 57. From the free edge 60 of each wall 56, upstands a tab 62 of generally rectangular shape midway between the ends of the edge 60.

The side walls 46 of the shell part 38 are provided with window latch means 64 positioned for latching engagement with the window latch means 36 of the side walls 17, the side walls 56 of the strain relief shell member 42 being provided with window latch means 66 positioned for latching engagement with the window latch means 36 of the side wall 28 of the cable strain relief shell member 14. The window latch means 64 and 66 are shown only diagrammatically.

The connector 8 comprises an insulating housing 68 having a front metal shielding plate 70 which extends across mounting flanges 72 at each end of the housing 68. Within the housing 68 are electrical terminals 74 (shown only diagrammatically), having means, for example crimping or insulation displacement, at the rear of the housing 68 connected to individual wires W of a multiwire shielded electrical cable C, the metal braid shield S of which has been folded back from a stripped end of the cable C so as to lie over the cable jacket J as best seen in FIG. 1A.

Each back shell member is a stamped and formed metal member having a generally planar base wall with one or more side walls depending from side edges thereof and defining a forward connector receiving portion and a rearward cable exit portion. When the back shell members are positioned over the connector, they form a cavity encompassing the rear of the connector and the wires of the cable.

As shown in FIGS. 2A through 3B, tooling 76 for cooperation with a crimping anvil 78 (FIG. 2B) to crimp the strain relief shell members 14 and 42 about the folded back part of the shield S of the cable C, comprises a pair of side plates 80 having side wall confining legs 82 and between the plates 80, a crimping die 84 having a pair of side wall confining legs 86 between which is a rectangular crimping projecting 88, bounded on either side by a concave, flange curling surface 90. The anvil 78 comprises an elongate flat working surface 92 which is raised above a base 94. A through slot 96 for slidably receiving an indentor 98 opens into the surface 92 proximate to each end thereof and also opens into the lower face of the base 94.

Figure 2A:
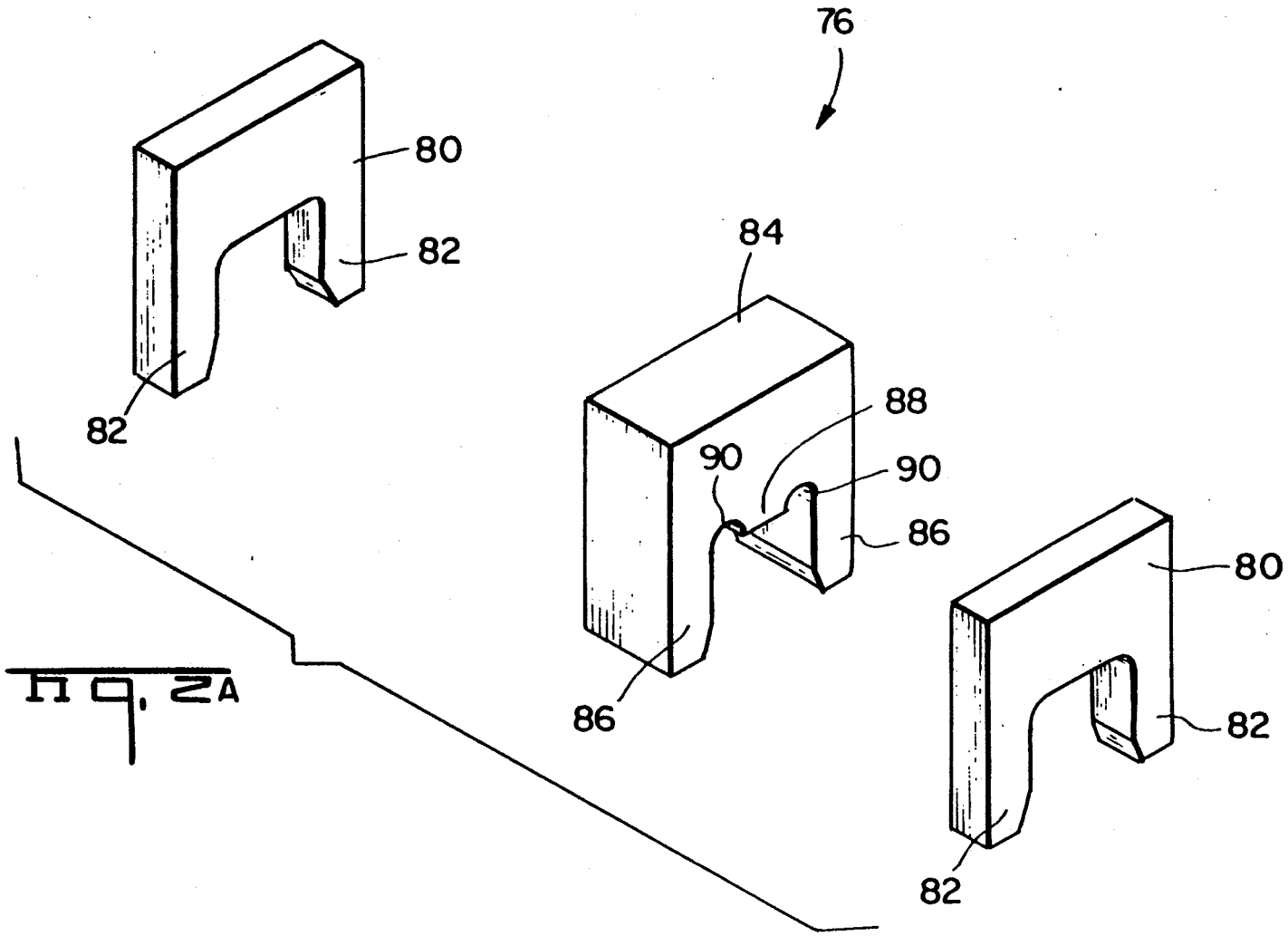
FIG. 2A is an exploded isometric view of the crimping tool used in crimping cable strain relief shell members of the back shell about the shielded cable.
Figure 2B:
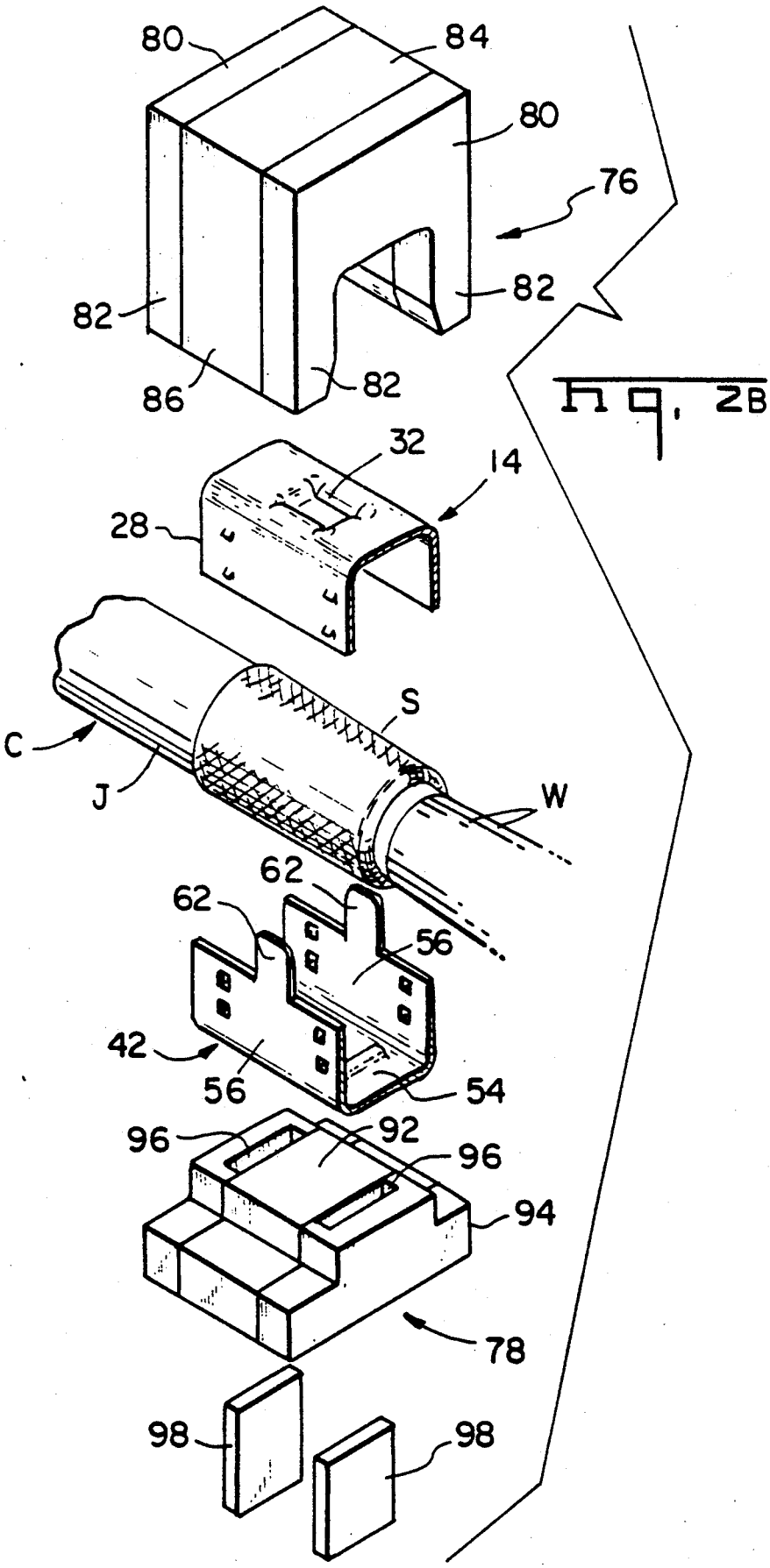
FIG. 2B is an isometric exploded view illustrating the crimping operation.
Figure 2C:
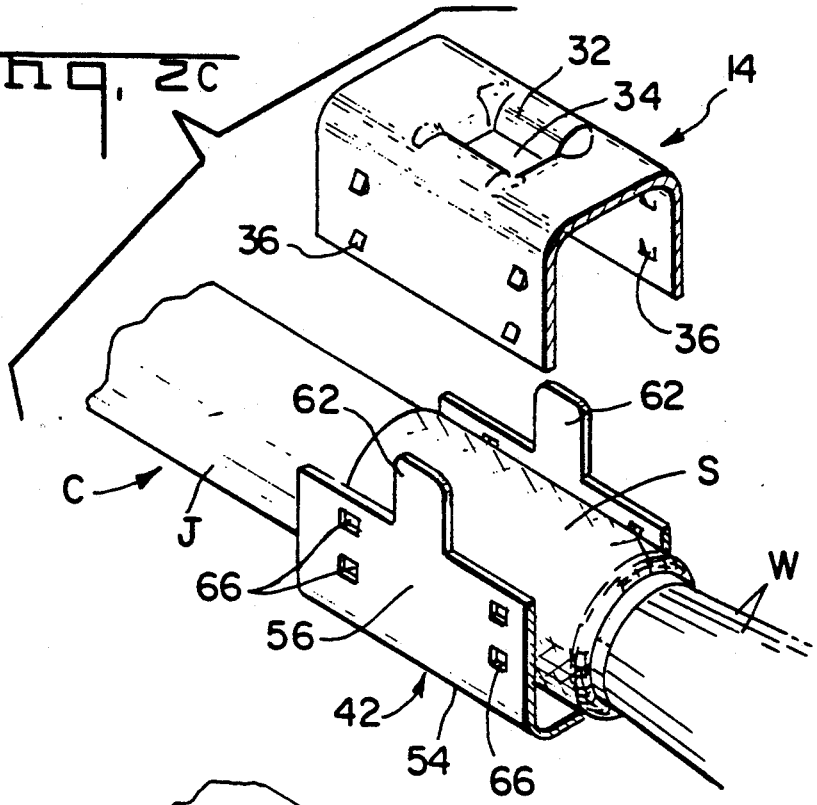
FIGS. 2C to 2E are fragmentary isometric views illustrating successive steps in the connection of the strain relief shell members to the cable.
Figure 2D:
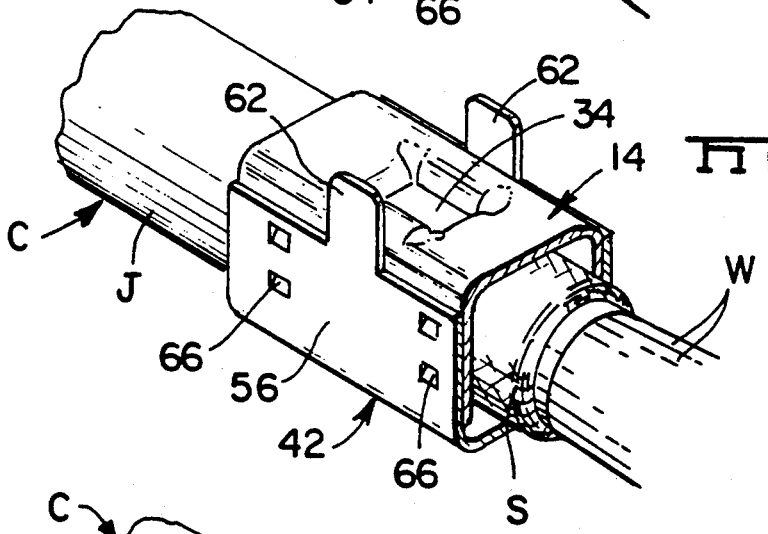
Figure 2E:
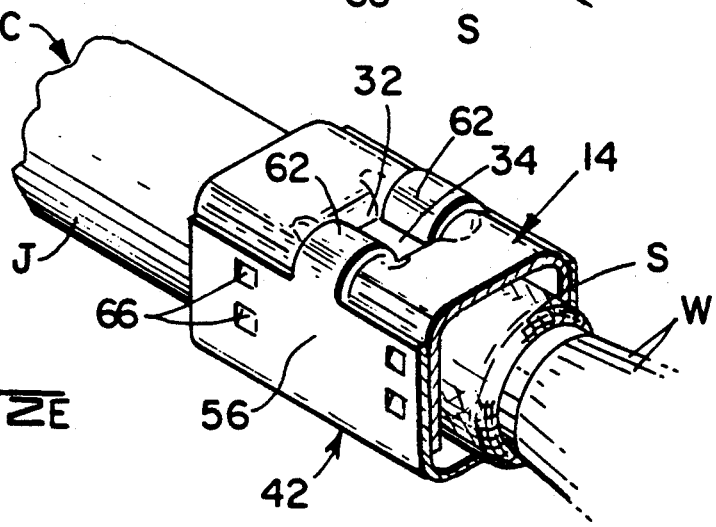

Reference will now be made to FIG. 2C to 2E, which show the strain relief shell members 14 and 42, but, for clarity, not the remainder of the back shell members 4 and 6. In order to assemble the back shell members 4 and 6 to the connector 8, the part of the cable C over the jacket J of which the braid shield has been folded back, is laid on the base wall 54 of the shell member 42 between the side walls 56 thereof as shown in FIG. 2C and the back shell members 4 and 6 are then latched together about the connector 8 in superposed relationship, by means of the window latch means 36 and 64, the strain relief shell members 14 and 42 being latched together about the external part of the braid shield S by means of the window latch means 36 and 66 as shown in FIG. 2D, the side walls 28 of the member 14, being received between the side walls 56 of the member 42. In this interengaged or mated position of the back shell members 4 and 6, the flanges 53 of the member 6 are aligned with, and project above, the recesses 22 of the member 4, the flanges 62 of the cable strain relief member 42 being aligned with, and projecting above, the recess 32 of the cable strain relief shell member 14 (FIG. 2D). The flanges 72 of the connector 8 are sandwiched between the flanges 18 and 48 on one side and transverse flanges 23 and 57 of the back shell members 4 and 6 with the apertures in flanges 18,48 and 72 aligned. The axial position of the cable C with respect to the shell members 14 and 42 can now, if need be, be adjusted.

The assembly 4, 6, 8 as thus far provided, is located in a jig (not shown) with the base wall 54 of the strain relief member 42 on the working surface 92 of the anvil 78 and the base wall 44 of the back shell member 6 on the flat working surface of a further anvil (not shown). The tooling 76 is then driven down through a working stroke, so that the legs 82 and 86 thereof embrace the side walls 56 of the member 42 between them, until the free ends of the legs 82 and 86 bottom on the anvil base 94. During said working stroke, the cross-sectional area of the cable is reduced due to being compressed, the flanges 62 of the member 42 are curled over by the concave surfaces 90 of the die 84 and are pushed down into the recess 32 of the strain relief shell member 14, by the crimping projection 88 of the die 84 as shown in FIG. 2E and the indentors 98 are raised through the slots 96 of the anvil 78 so as to form transverse indentations 106 in the base wall 54 of the member 42. Alternatively, transverse indentations 106 may be formed in base wall 54 during stamping and forming of the back shells. The strain relief members 14 and 42 are thereby firmly crimped about the cable C in contact with the folded back part of the shield S thereof to provide strain relief for the cable C and permanent electrical connection between the shield S and the back shell members 4 and 6. The relative positions of the tooling 76, anvil 78, the strain relief members 14 and 42 and the cable C during the crimping operation are shown in exploded form in FIG. 2B.

Figures 5, 6:
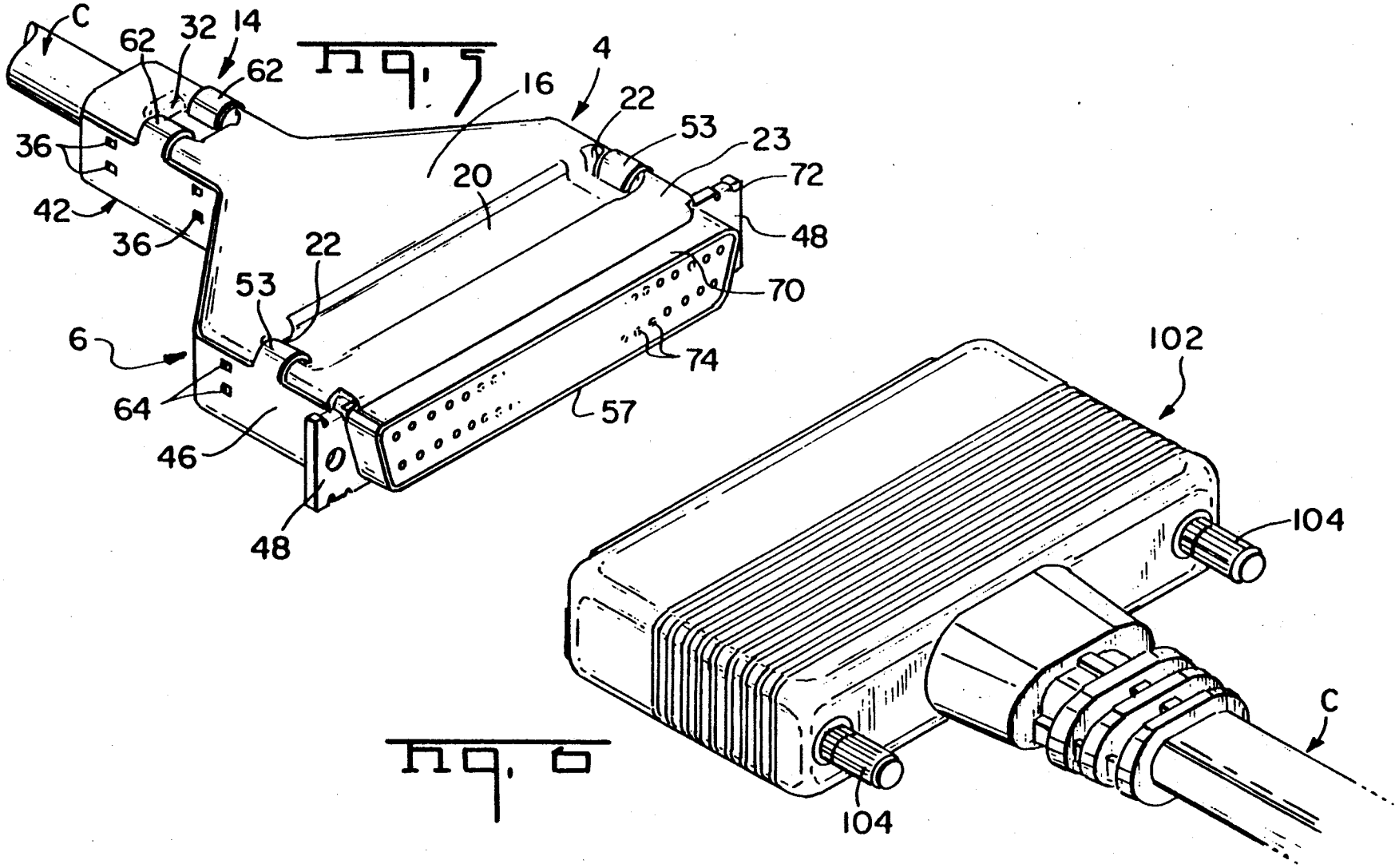
FIG. 5 is an isometric view showing the back shell assembled to the connector and the cable.
FIG. 6 is an isometric view showing the assembly illustrated in FIG. 5 with an insulating housing molded thereabout.

During the crimping operation described above, further tooling (not shown) is driven through a working stroke to crimp down the flanges 53 of the back shell members 6 into the respective recesses 22 of the back shell member 4, permanently to secure the members 4 and 6 to the connector 8 which is firmly gripped between the ribs 20 and 50 of the members 4 and 6, respectively, and is restrained from forward movement by the flanges 23 and 57. The assembly so produced is shown in FIG. 5. As shown in FIG. 6, a plastic housing 102 may be slid over or molded over the assembly so as to enclose the back shell members 4 and 6 and their strain relief shell members 14 and 42, jack screws 104 being provided in the housing 102 for securing the connector 8 to a mating connector (not shown).

FIGS. 3A to 3C, in which the cable C and the anvil 78 are not shown, illustrate the crimping action of the die 84, described above and best show the cross sectional configuration of the cable strain relief shell members 14 and 42.

Figures 4A, 4B:
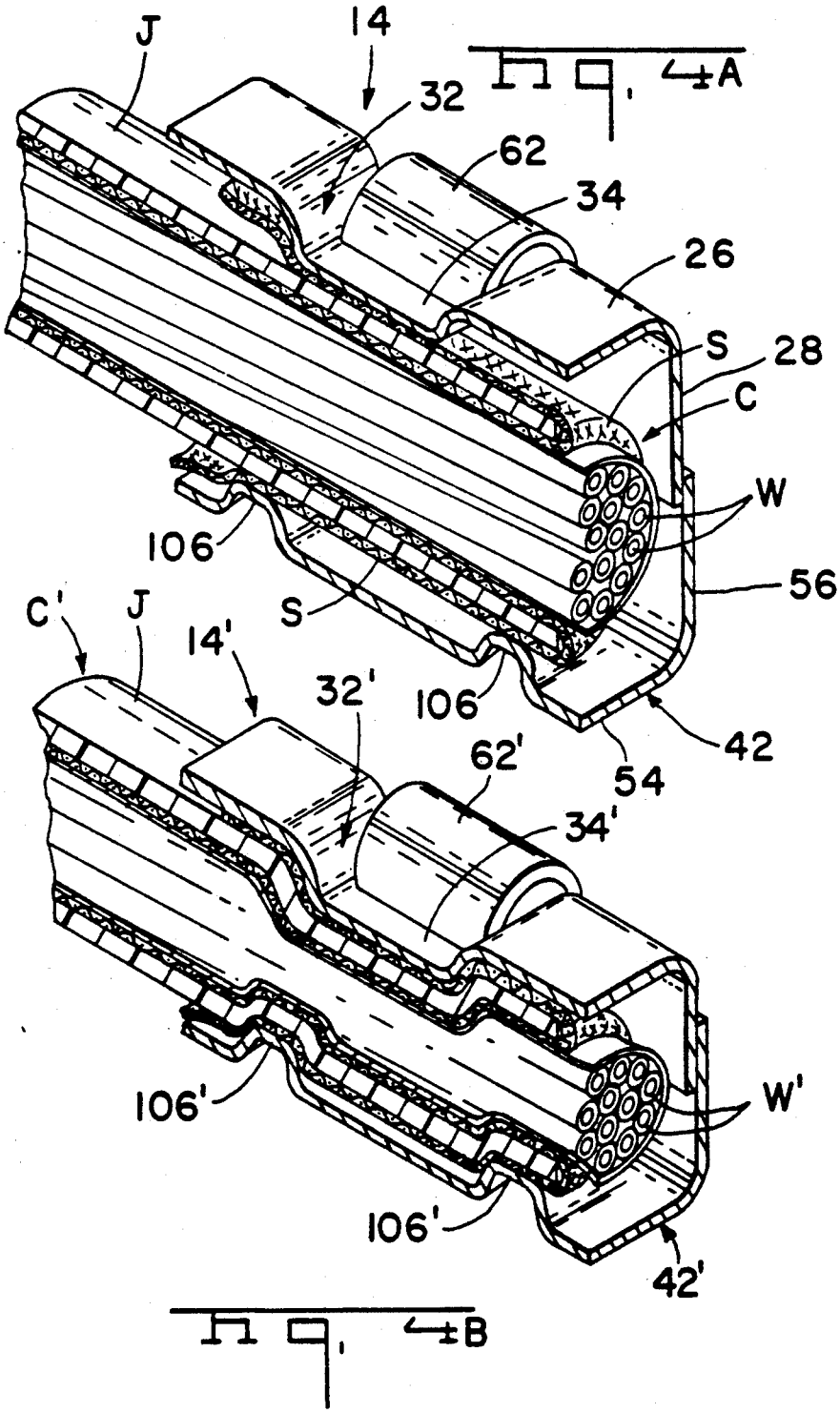
FIG. 4A is an enlarged longitudinal sectional view illustrating crimped connection between the cable strain relief shell members and the cable.
FIG. 4B is a similar view to that of FIG. 4A but showing such cable strain relief shell members crimped to a cable of a smaller gauge than that shown in FIG. 4A.

FIG. 4A shows in axial section, the crimped connection produced as described above between the members 14 and 42 with the cable C compressed therebetween. As shown in FIG. 4A, the folded back part of the braid shield S of the cable C is tightly gripped between the inside surface of the bottom 34 of the recess 32 and the inside surface of transverse indentations 106 formed in the base wall 54 of the member 42. The strain relief shell thereby provided by the shell members 14 and 42 may be adapted to different cable gauges or diameters, by appropriately selecting the depth of the recess 32 and/or the depth of the indentations 106. FIG. 4B shows cable strain relief shell members 14*a* and 42*a* having a recess 32' of greater depth than the recess 32 and indentations 106' of greater depth than the indentations 106, crimped to a cable C' of substantially smaller diameter than the cable C.

A second embodiment of the back shell will now be described with reference to FIGS. 7A to 7E in which parts which are the same as, or have the same function as, corresponding parts of the back shell members 4 and 6, described above, bear the same reference numerals as such corresponding parts but with the addition of a prime symbol.

Figure 7A:
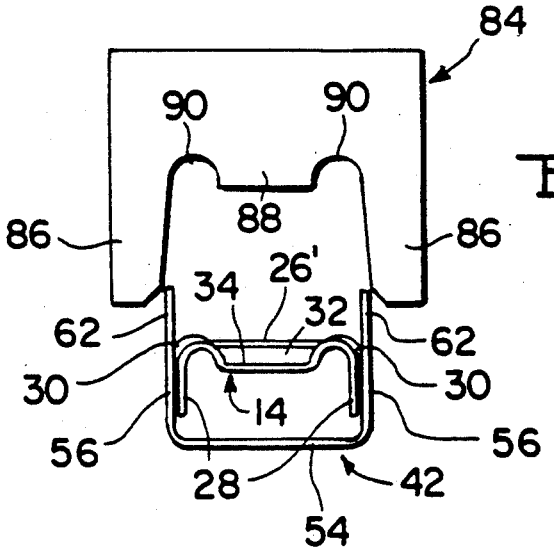
FIG. 7A is a plan view of a sheet metal blank for producing a back shell member of a back shell according to a second embodiment of the invention.

As shown in FIG. 7A, sheet metal blank 6" which can be formed along fold lines 110 to provide a back shell member 6' has a neck 112 connecting a part 42" of the blank 6", for forming the cable strain relief shell member 42' of the member 6' to a blank part 40" for forming the part 40' of the member 6'. The remaining parts of the blank 6" bear the same reference numerals as the corresponding parts of the member 6, but with the addition of a further prime symbol.

Figure 7B:
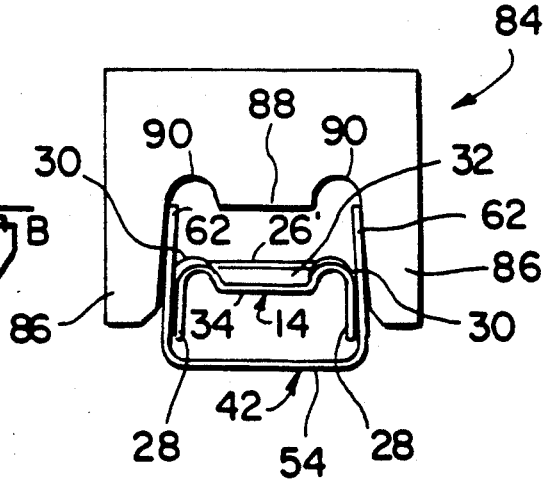
FIG. 7B is a view of the back shell member produced by means of the blank shown in FIG. 7A.
Figure 7C:
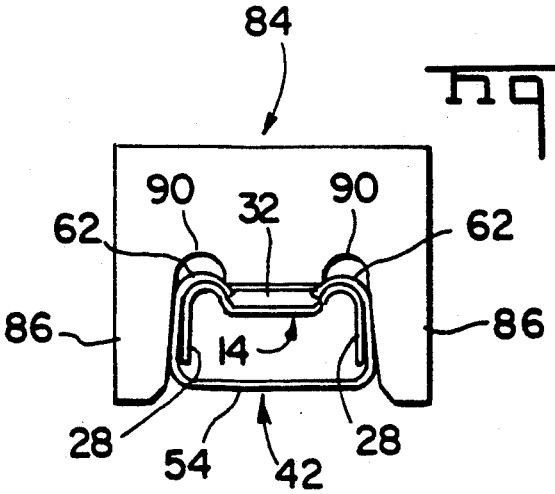
FIG. 7C is an end view, partially in section, of the back shell member shown in FIG. 7B.
Figure 7B:
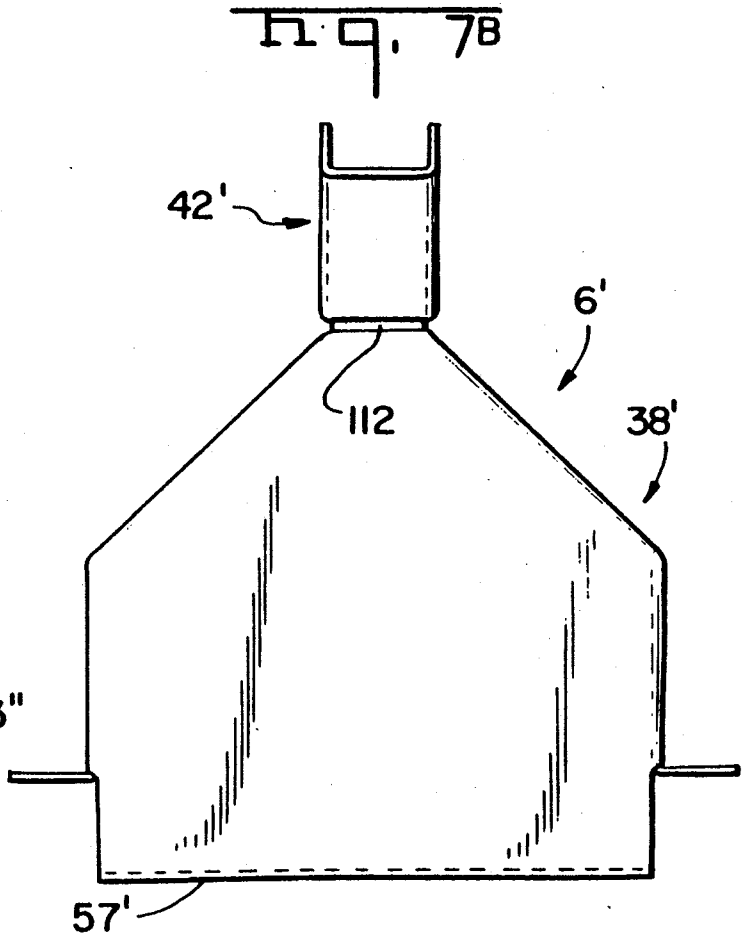
Figure 7A:
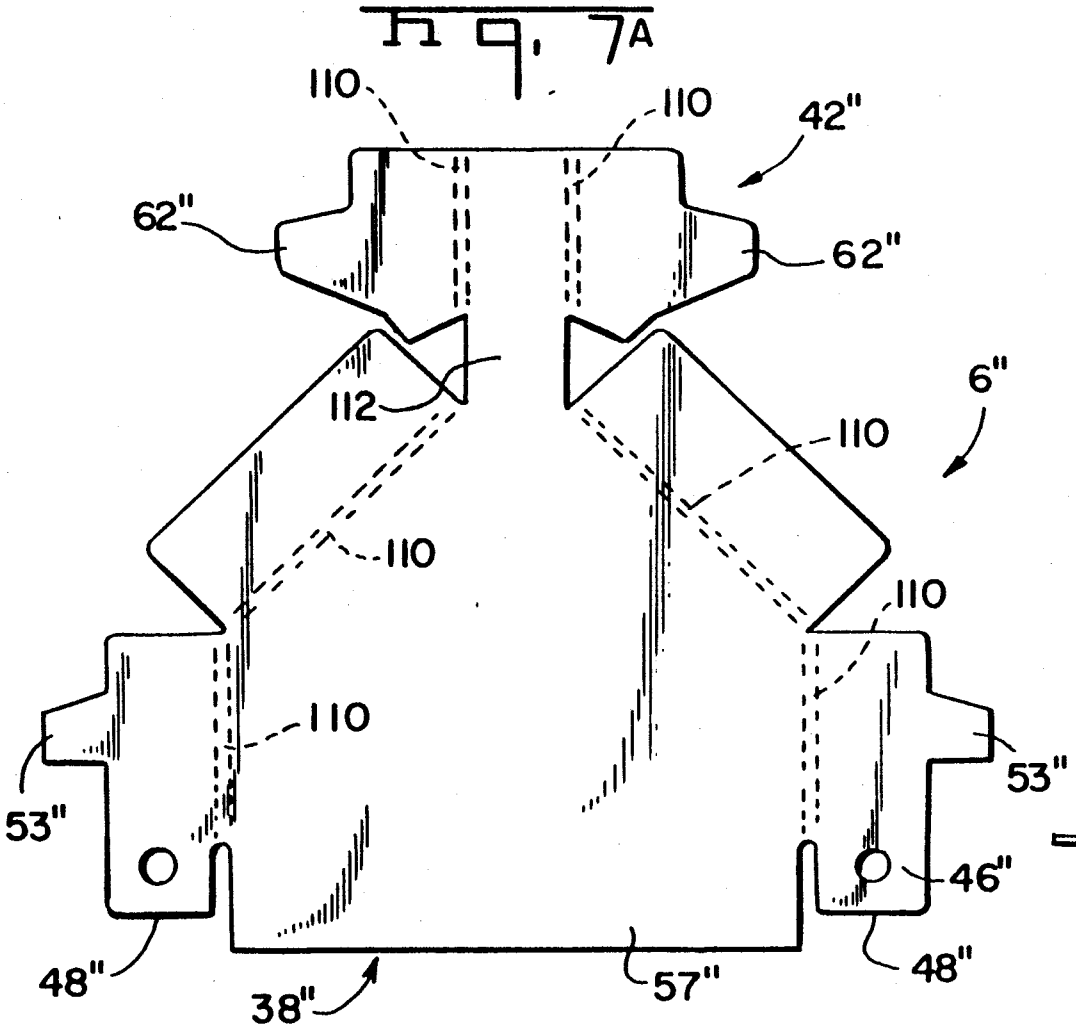
Figure 7D:
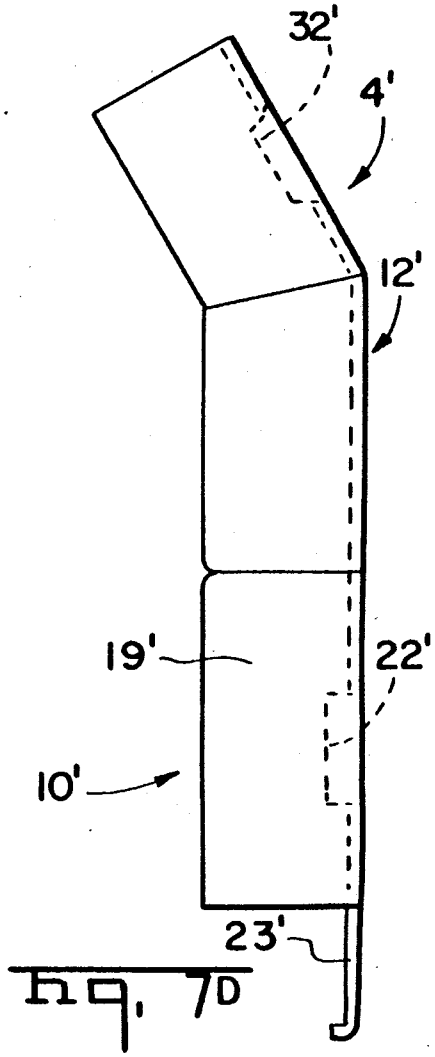
FIG. 7D is an end view of the other back shell member of said other embodiment.
Figure 7E:
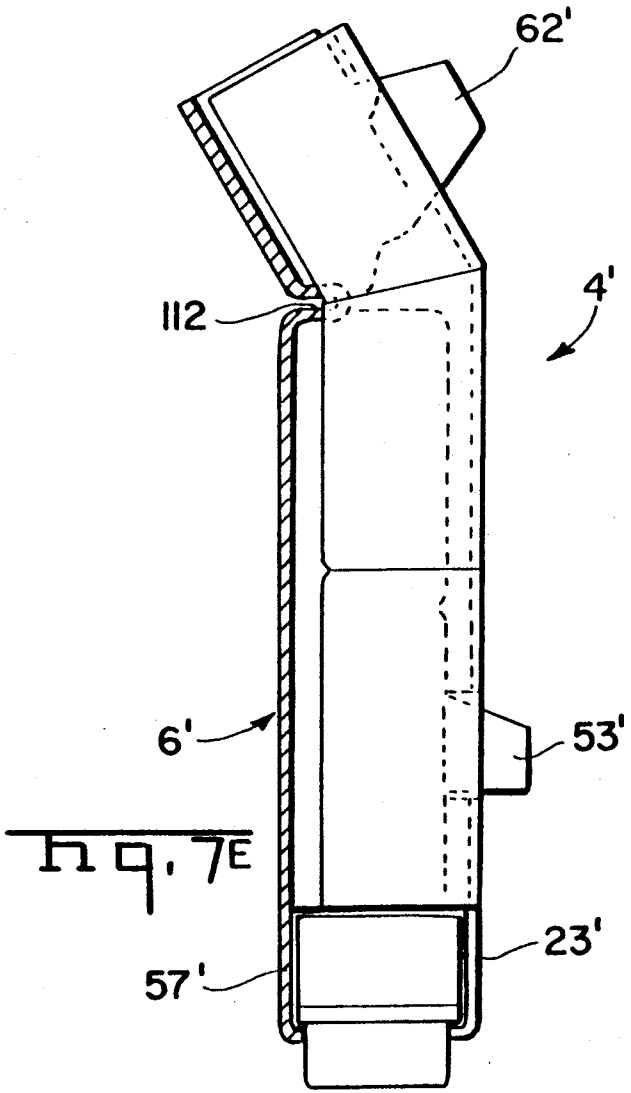
FIG. 7E is an end view illustrating the back shell members of FIGS. 7B to 7D when mated, prior to a crimping operation being performed thereon.
Figure 7C:
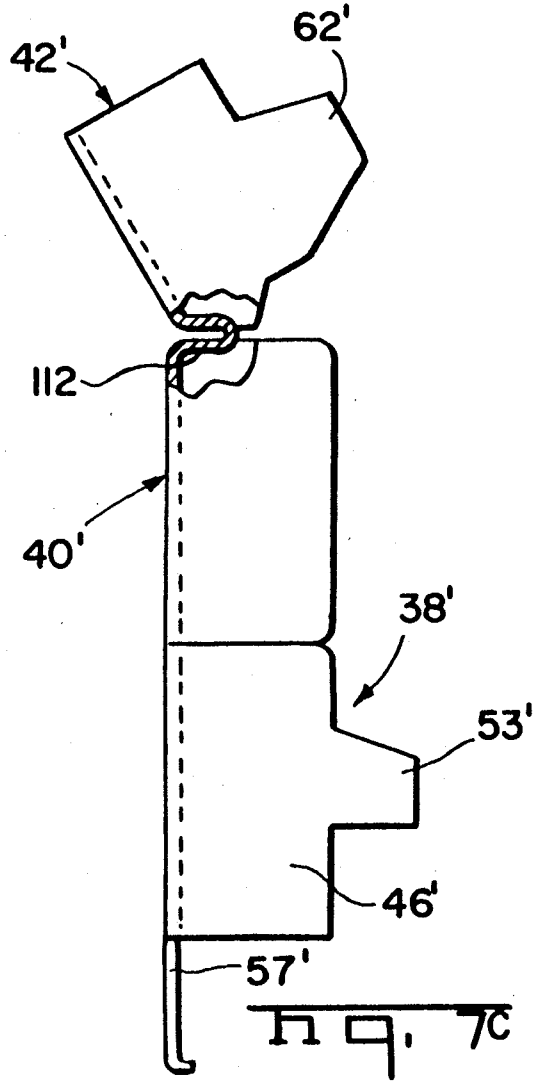

After, or during, the folding of the blank 6" along the fold lines 110, the neck 112 is doubled over as best seen in the partial sectioned portion of FIG. 7C, so that the transition between the strain relief shell member 42' and the cable wire receiving part 40' is closed, as will also be apparent from FIG. 7B, which shows the member 6' in elevation. In order to produce an angled lead-in for the cable, the member 42' may be angled about the doubled over neck 112 as shown in FIG. 7C. The cable strain relief shell member 14' is similarly angled with respect to the cable wire receiving part 12' of the member 4' as shown in FIG. 7D. FIG. 7E shows the members 4' and 6' when they have been mated, prior to being crimped about the cable in the manner described above with the angled cable exit at the top of the figure.

Figure 8:
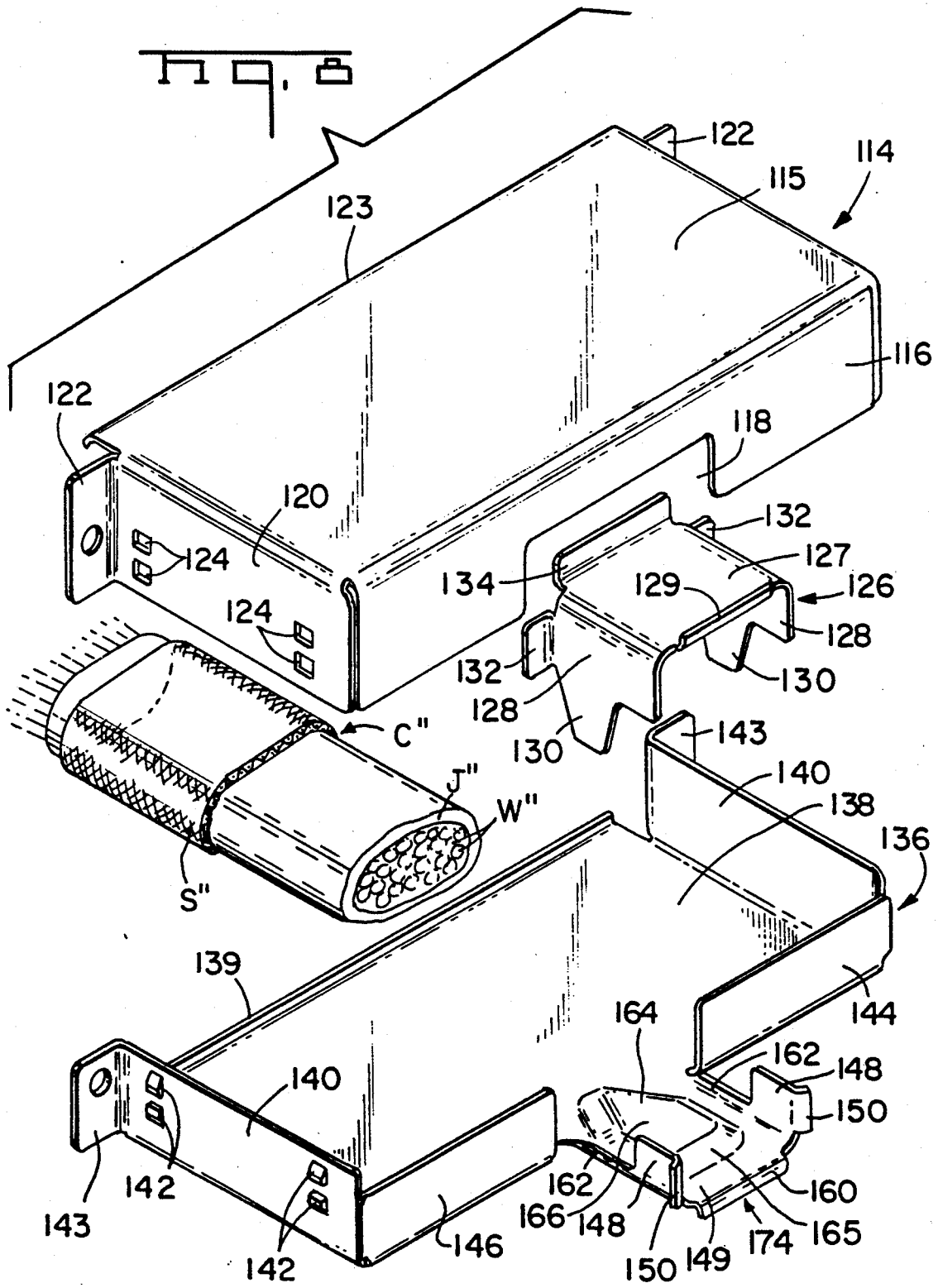
FIG. 8 is an exploded isometric view of a back shell according to a further embodiment of the invention.
Figure 9:
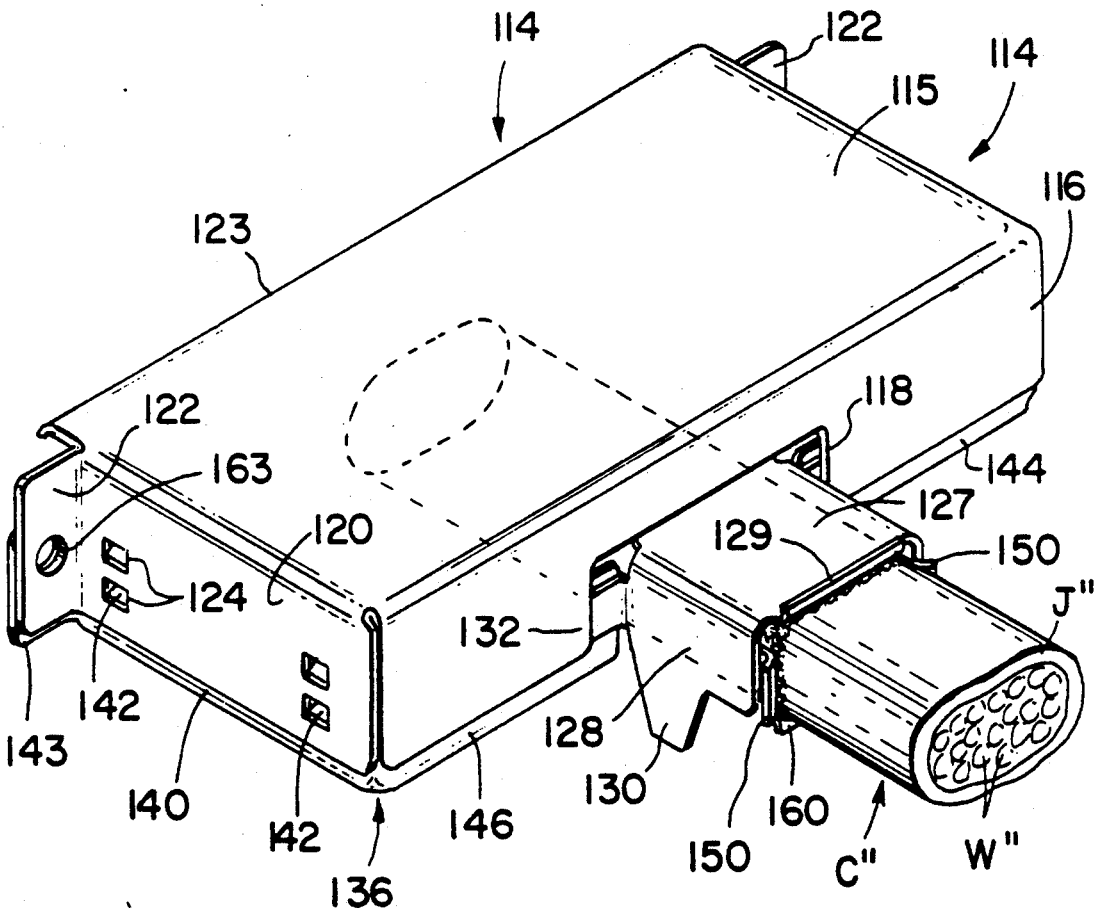
FIG. 9 is an isometric view showing the back shell of FIG. 8 with back shell members thereof in a mated position, prior to a crimping operation being performed thereon.

A third embodiment of the connector shielding back shell will now be described with reference to FIGS. 8 and 9. This back shell is intended to receive a flat, multi-contact electrical connector (not shown) of rectangular shape as described above. The back shell consists of a back shell member 114, a cable strain relief shell member 126 which is in the form of a staple which is separate from but securable to the member 114, and a further back shell member 136.

The back shell member 114, which is substantially rectangular, comprises a base wall 115, from which depend a front wall 116 having a central cut out 118, two opposite side walls 120 formed with apertured forward flanges 122 having apertures, latching windows 124, and a forward connector retaining flange 123. The cable strain relief member 126 comprises a base wall 127 from which depend, by way of rounded transitions, opposite side walls 128 from the free longitudinal edge of each of which extends a crimping flange 130 which may be slightly tapered in a direction away from the respective side wall 128. Each side wall 128 has an outwardly directed forward flange 132 projecting normally thereof, the base wall 127 having a forward, outwardly directed, flange 134 projecting normally thereof across its full width. The wall 127 may be formed with an arcuate, rearward, cable lead in flange 129 which also extends along its width.

The back shell member 136 comprises a base wall 138 from which upstand opposite side walls 140 provided with latches 142 for engaging in the windows 124 of the shell member 114 and is also formed with apertured forward flanges 143. There also upstand from the wall 138 a forward, connector retaining flange 139 and opposite thereto, a pair of spaced rear walls 144 and 146 defining a cable exit between them. There projects from the base wall 138, between the walls 144 and 146, a cable strain relief shell member 147, comprising a base wall 149 from which upstand rearward side walls 148 having cable lead-in arcuate flanges 150 projecting laterally therefrom. Rudimentary side walls 162 of the base wall 149, connect the side walls 148 to the base wall 138. Between the side walls 148, the base wall 149 is formed with an arcuate, cable lead in flange 160. The base wall 149 is formed with a recess 164 between the side walls 162, recess 164 opening downwardly, as seen in FIG. 8, and which has a rounded peripheral wall 165 which is downwardly concave, the recess 164 having a flat bottom 166.

In order to assemble the back shell members 114 and 136 to the connector, when its terminals have been connected to the wires W" of a shielded connector C" the braid shield S" of which has been folded back along the cable jacket J" the connector is placed in the back shell 136 between the side walls 140 thereof with the part of the cable C" along which the shield S" has been folded back, in the cable strain relief member 147 between the side walls 148 and 162 thereof. The back shell members 114 and 136 are then mated in superposed relationship as shown in FIG. 9, with the flanges 132 and 134 of the shell member 126 engaged forward of front wall 116 of the back shell member 114. Latches 142 engage in the latching windows 124 to retain the members 114 and 136 in their mated relationship. In said relationship, the side walls 128 of the member 126 embrace the side walls 148 and 162 of the member 147, the flanges 130 on the walls 128 projecting beyond the member 147 as shown. The flanges 130 are curled over to engage the wall 165 of the pocket 164, by means of tooling of the kind described above, so that the members 126 and 147 are crimped about the cable C" to produce a crimped connection of the kind described above reference to FIGS. 4A and 4B.

We claim:

1. A shielding back shell for an electrical connector, the electrical connector adapted to be terminated to conductors of a shielded electrical cable, the back shell comprising:

first and second back shell members configured to be secured together about said connector, in superposed relationship;

cable strain relief shell means for securing about external shielding on a length of said cable, said cable strain relief shell means comprising a first cable strain relief shell member connected to said first back shell member and a second cable strain relief shell member connected to the second back shell member, said strain relief shell members being interengageable with each other in nested relationship to enclose said externally shielded length of the cable and being provided thereon with flange means and recess means, said flange means being crimpable into said recess means for securing said strain relief shell members in firm engagement with said external shielding on said cable;

wherein each cable strain relief shell member comprises a base wall and opposed side walls upstanding from said base wall, said flange means comprising at least one flange upstanding from a side wall of at least the first strain relief shell member, said recess means comprising at least external, one recess formed in the base wall of at least the second strain relief shell member.

2. The invention as recited in claim 1, wherein said first strain relief shell member is provided with means detachably securing it to said first back shell member.

3. A back shell as recited in claim 1, wherein each cable strain relief shell member is formed integrally with a respective one of said back shell members.

4. The invention as recited in claim 1, wherein means are provided on said strain relief shell members for latching them together about said externally shielded cable length.

5. The invention as recited in claim 1, further comprising window latch means on the side walls of each of said strain relief shell members for cooperation to latch said strain relief shell members in engagement with each other.

6. The invention as recited in claim 1, wherein a base wall of said recess engages said external shielding from one side of said cable, said flanges being crimped into said recess and the base wall of said first strain relief shell member having indentations projecting into said external shielding from the opposite side of said cable.

7. The invention as recited in claim 1, wherein said recess is bounded by arcuately convex transition portions of said second strain relief shell member connecting the side walls to the base wall thereof.

8. The invention as recited in claim 1, wherein the base wall of said first strain relief shell member is flat and said recess has a flat base wall.

9. A shielding back shell for an electrical connector, the electrical connector adapted to be terminated to conductors of a shielded electrical cable, the back shell comprising:

first and second back shell members configured to be secured together about said connector, in superposed relationship;

cable strain relief shell means for securing about external shielding on a length of said cable, said cable strain relief shell means comprising a first cable strain relief shell member connected to said first back shell member and a second cable strain relief shell member connected to the second back shell member, said strain relief shell members being interengageable with each other to enclose said externally shielded length of the cable and being provided thereon with flange means and recess means, said flange means being crimpable into said recess means for securing said strain relief shell members in firm engagement with said external shielding on said cable, wherein each of said strain relief shell member is connected to a respective one of said back shell members by means of a double over neck.

10. The invention as recited in claim 9, wherein said strain relief shell members are angled in the same direction and to the same extent with respect to said back shell members to provide an angled exit for said cable.

11. A shielding back shell for an electrical connector, the electrical connector having contacts adapted to terminate to respective conductors of a shielded electrical cable, said back shell comprising:

first and second back shell members each having a base wall and opposed side walls upstanding from opposite lateral edges of said base wall, said side walls being spaced from each other for receiving said connector therebetween, a rear edge of said base wall extending transversely of said lateral edges thereof, the side walls of the second back shell member being receivable between those of the first back shell member; and first and second cable strain relief shell members each having a base wall and opposed side walls upstanding from opposite edges thereof and being spaced for receiving the said cable between them, the side walls of the second cable strain relief shell member being receivable between those of the first cable strain relief shell member, the base wall of each of said strain relief shell members being connected to a respective one of said back shell members and projecting beyond the said rear edge thereof normally of the side walls thereof, at least one flange upstanding from at least one side wall of the first cable strain relief shell member, and the second cable strain relief shell member having formed in the base wall thereof at least one recess into which said at least one flange is deformable for securing said strain relief shell members in internested relationship about said cable in firm permanent engagement therewith when the conductors of the cable are terminated to contacts of the connector and the cable is secured between the shielding back shell members.

12. A back shell as recited in claim 11, wherein the first strain relief shell member is formed integrally with the base wall of the first back shell member and the second strain relief shell member is formed integrally with the base wall of the second back shell member.

13. A back shell as recited in claim 11, wherein a rear wall having an aperture extends along said rear edge of the base wall of the first back shell member, said first strain relief shell member being in the form of a staple which is separated from the first back shell member, mounting flanges projecting from said first strain relief shell member for insertion through said aperture to engage a forward face of said rear wall.

14. A back shell as recited in claim 11, further comprising means on the side wall of said strain relief shell members for latching said shell members together in said internested relationship.

15. A back shell as recited in claim 11, wherein each side wall of said first strain relief shell member has a free edge remote from the base wall thereof, one of said flanges upstanding from each of said free edges, the base wall of said second strain relief shell member being formed with a recess for receiving each flange and being connected to the side walls of the second strain relief shell member by outwardly convex transitions about which said flanges are deformable.

16. A back shell as recited in claim 11, wherein said first strain relief shell member is angled with respect to the base wall of the first back shell member, said second strain relief shell member being similarly angled with respect to the base wall of the second back shell member to provide an angled lead-in for the cable.

17. A back shell as recited in claim 11, wherein flange and recess means are provided for securing said back shell members together in internested relationship.

18. A back shell as recited in claim 11, wherein each side wall of said first strain relief shell member has a free edge remote from the base wall thereof, one of said flanges upstanding from each of said free edges, the base wall of said second strain relief shell member being formed with a central recess bounded by outwardly convex surfaces about which said flanges are deformable.

19. A back shell as recited in claim 18, wherein said recess has a flat bottom.

20. A ferruleless back shell for securing to a cable having conductors thereof terminated to contacts of a connector, the ferruleless back shell comprising:

a first back shell member having a forward connector receiving portion and a rearward cable exit, said first back shell member having a base with at least one side wall depending from a side edge thereof, said side wall extending to a free edge, at least one tab extending beyond the free edge proximate said cable exit, said first back shell member adapted to receive the connector proximate a forward edge with a cable passing through the cable exit; and a second back shell member defining a cable exit and having a base, said base of the second back shell member being formed proximate to the cable exit of the second back shell member with a blind recess opening outwardly of the cable exit of the second back shell member, said second back shell member being adapted to be positioned over the connector, enclosing a cavity between said back shell members in which the connector is adapted to be received, said at least one tab being adapted to be formed over into said recess of the second back shell to secure the first and second back shell members together and to clamp the cable therebetween.

21. A ferruleless back shell as recited in claim 20, further comprising indents in the cable exit of one of the back shells to reduce the available cross section for the cable when the first and second back shells are positioned over the connector, whereby a cable with a smaller diameter can be clamped.

22. A ferruleless back shell as recited in claim 20, further comprising latching means on said at least one side wall proximate the forward connector receiving portion, said latching means for securing the first and second back shell members together.

23. A ferruleless back shell as recited in claim 22, wherein the latching means comprise at least one tab extending beyond the free edge, said at least one tab adapted to be formed over a portion of the second back shell to secure the first and second back shell members together proximate the forward connector receiving portion.

24. A shielded electrical connector having a ferruleless back shell, comprising:

an electrical connector having contacts terminated to conductors of a multi-conductor cable;

a first back shell member having a forward connector receiving portion and a rearward cable exit, said side wall extending to a free edge, at least one tab extending beyond the free edge proximate said cable exit, the electrical connector positioned in the first back shell proximate a forward edge with a cable passing through the cable exit; and a second back shell member positioned over said first back shell, connector and cable, said second back shell defining a cable exit and having a base formed proximate to the cable exit of the second back shell with a recess opening outwardly of the cable exit of the second back shell and having a closed bottom projecting inwardly into the cable exit of the second back shell said second back shell member enclosing a cavity between said back shells in which the connector is received, said at least one tab being formed over into the recess of the second back shell proximate to the cable exit thereof to secure the first and second back shells together and to clamp the cable between the cable exits thereof.

25. A shielding back shell for an electrical connector adapted to be terminated to conductors of a shielded electrical cable, the back shell comprising:

first and second back shell members configured to be secured together about said connector, in superposed relationship;

cable strain relief shell means for securing about external shielding on a length of said cable, said cable strain relief means comprising a first cable strain relief shell member connected to said first back shell member and a second cable strain relief shell member connected to the second back shell member, said strain relief shell members being interengageable with each other to enclose said externally shielded length of the cable and being provided thereon with flange means and recess means, said flange means being crimpable into said recess means for securing said strain relief shell members in firm engagement with said external shielding on said cable, wherein each of said strain relief shell members comprises a base wall and opposed side walls projecting from opposite edges of said base wall, the side walls of said second strain relief shell member being receivable between the side walls of said first strain relief shell member, at least one recess being formed in the base wall of said second strain relief shell member and flanges being provided on the side walls of said first strain relief shell member, said flanges being crimpable into said at least one recess.

26. A shielding back shell for an electrical connector, the electrical being adapted to be terminated to conductors of a shielded electrical cable, the back shell comprising:

first and second back shell members configured to be secured together about said connector, in superposed relationship;

cable strain relief shell means for securing about external shielding on a length of said cable, said cable strain relief means comprising a first cable strain relief shell member connected to said first back shell member and a second cable strain relief shell member connected to the second back shell member, said strain relief shell members being interengageable with each other to enclose said externally shielded length of the cable and being provided thereon with flange means and recess means, said flange means being crimpable into said recess means for securing said strain relief shell members in firm engagement with said external shielding on said cable; wherein each said strain relief shell member is connected to a respective one of said back shell members by means of a doubled over neck.

27. A shielding back shell for an electrical connector, the electrical being adapted to be terminated to conductors of a shielded electrical cable, the back shell comprising:

first and second back shell members configured to be secured together about said connector, in superposed relationship;

cable strain relief shell means for securing about external shielding on a length of said cable, said cable strain relief means comprising a first cable strain relief shell member connected to said first back shell member and a second cable strain relief shell member connected to the second back shell member, said strain relief shell members being interengageable with each other to enclose said externally shielded length of the cable and being provided thereon with flange means and recess means, said flange means being crimpable into said recess means for securing said strain relief shell members in firm engagement with said external shielding on said cable, wherein each of said strain relief shell members comprise a base wall and opposed side walls projecting from opposite side edges of said base wall, the side walls of said second strain relief shell member receivable between the side walls of said first strain relief shell member, at least one recess being formed in the base wall of said second strain relief shell member and said at least one flange comprising a plurality of flanges provided on the side walls of said first strain relief member.

* * * * *

UNITED STATES PATENT AND TRADEMARK OFFICE

CERTIFICATE OF CORRECTION

PATENT NO. : 5,199,903

DATED : April 6, 1993

INVENTOR(S) : John S. Asick et al.

It is certified that error appears in the above-indentified patent and that said Letters Patent is hereby corrected as shown below:

Column 12, line 15, change "electrical being" to --electrical connector--.

Signed and Sealed this

Thirteenth Day of September, 1994

*Attest:*

*Attesting Officer*

BRUCE LEHMAN

*Commissioner of Patents and Trademarks*